US006782588B1

(12) United States Patent
Liu

(10) Patent No.: US 6,782,588 B1
(45) Date of Patent: Aug. 31, 2004

(54) CLAMP DEVICE ADAPTED FOR MAINTAINING A TIGHTENED STATE OF A STRING

(76) Inventor: Kun-Chung Liu, No. 5, Alley 9, Lane 212, San Feng Rd., Hou-Li Hsiang, Taichung Hsien (TW)

( * ) Notice: Subject to any disclaimer, the term of this patent is extended or adjusted under 35 U.S.C. 154(b) by 0 days.

(21) Appl. No.: 10/463,570

(22) Filed: Jun. 18, 2003

(51) Int. Cl.[7] ..... A43C 7/00; A43C 7/08

(52) U.S. Cl. ..... 24/712.5; 24/134 KB; 24/712.6

(58) Field of Search ..... 24/132 R, 134 KB, 24/132 AA, 712.2, 712.6, 713.2, 712.9, 712.5; 36/50.1

(56) References Cited

U.S. PATENT DOCUMENTS 1,363,693 A * 12/1920 Swanson ..... 24/712.6
1,710,273 A * 4/1929 Sebring et al. ..... 24/134 KB
2,315,196 A * 3/1943 Gallione ..... 24/713.5
2,444,841 A * 7/1948 Meronk ..... 24/134 KB
5,097,573 A * 3/1992 Gimeno ..... 24/712.5
6,148,489 A * 11/2000 Dickie et al. ..... 24/712.5

FOREIGN PATENT DOCUMENTS

EP 1103198 A1 * 5/2001 ..... A43C/7/00

* cited by examiner

*Primary Examiner*—Robert J. Sandy
(74) *Attorney, Agent, or Firm*—Foley & Lardner LLP

(57) ABSTRACT

A clamp device for a string includes a housing that confines an operating space and that is formed with string inlet and string outlet holes. Each of a pair of clamp members has a pivot portion pivotally retained in the housing, and a clamping portion that extends from the pivot portion and that has an inclined end face. The clamping portions are movable toward each other from a releasing position to a clamping position, where the inclined end faces cooperate to form a diverging clamping space that is communicated with the string inlet hole. Stop blocks on the inclined end faces limit movement of the clamping portions from the releasing position to the clamping position. An operating unit is connected to the clamp members, and is operable for moving the clamping portions from the clamping position to the releasing position.

10 Claims, 8 Drawing Sheets

CLAMP DEVICE ADAPTED FOR MAINTAINING A TIGHTENED STATE OF A STRING

BACKGROUND OF THE INVENTION

1. Field of the Invention

The invention relates to a clamp device, more particularly to a clamp device suitable for maintaining a tightened state of a string, such as a shoestring.

2. Description of the Related Art

Referring to FIG. 1, a conventional clamp device for a string 3 is shown to include a stationary member 1 and a locking member 2. The stationary member 1 has a notched upper portion 101, and a lower portion formed with a string hole 102 therethrough. The string hole 102 is confined by a hole-confining wall 103. The locking member 2 is generally U-shaped in cross-section, and has an upper pivot portion 201 extending into the notched upper portion 101 and connected pivotally to the stationary member 1, a lower restricting portion 202 extendable into the string hole 102, and an operating projection 203 formed between the pivot and restricting portions 201, 202. The restricting portion 202 has a lower clamping side 204 disposed to confront the hole-confining wall 103 and formed with a set of teeth 205.

In use, after the string 3 is extended through the string hole 102, the locking member 2 can be pivoted relative to the stationary member 1 to extend the restricting portion 202 into the string hole 102. At this time, the teeth 205 on the restricting portion 202 engage the string 3 and force the string 3 against the hole-confining wall 103, thereby preventing movement of the string 3 in the string hole 102. Thereafter, when the locking member 2 is pivoted relative to the stationary member 1 to extend the restricting portion 202 out of the string hole 102, the teeth 205 on the restricting portion 202 cease to engage the string 3 so as to permit movement of the string 3 in the string hole 102.

The following are some of the drawbacks of the conventional clamp device:

1. When the clamp device is applied to a shoestring, repeated pivoting movement of the locking member 2 is required to adjust a position of the shoestring before the shoestring can be maintained at a tightened state.

2. The presence of the teeth 205 on the restricting portion 202 can damage the surface of the string 3, thereby shortening the service life of the string 3.

3. Because the locking member 2 is pivoted with the use of the operating projection 203, the overall size of the clamp device should be relatively large to facilitate pivoting operation of the locking member 2.

SUMMARY OF THE INVENTION

Therefore, the object of the present invention is to provide a clamp device, which is suitable for maintaining a tightened state of a string, which can be easily operated, which does not damage the string, and which has a relatively small size.

According to the present invention, a clamp device is adapted for use with a string, and comprises a housing, a pair of clamp members, and an operating unit.

The housing confines an operating space, and is formed with a string inlet hole and at least one string outlet hole that are communicated with the operating space. The string inlet hole has a first hole axis, and a pair of first hole edges opposite to each other in a first direction transverse to the first hole axis.

Each of the clamp members, which are disposed in the operating space, has a pivot portion and a clamping portion connected to the pivot portion. The pivot portion of each of the clamp members is disposed adjacent to a respective one of the first hole edges of the string inlet hole, and is pivotally retained in the housing to permit pivoting movement of the clamp members about a respective pivot axis that extends in a second direction transverse to both the first direction and the first hole axis. The clamping portion of each of the clamp members extends from the pivot portion toward the first hole axis, and has a first side face, a second side face that is opposite to the first side face in a third direction transverse to the first and second directions and that is disposed to confront the string inlet hole, and an inclined end face that is remote from the pivot portion and that extends from the first side face to the second side face. The clamp members are pivotable so as to move the clamping portions thereof toward each other from are leasing position to a clamping position, where the inclined end faces of the clamping portions of the clamp members cooperate to form a clamping space that is communicated with the string inlet hole, that diverges along the first hole axis in a direction away from the string inlet hole, and that has a wider section and a narrower section between the wider section and the string inlet hole. The clamping portion of each of the clamp members is formed with a stop block that extends from the inclined end face and that is formed with an inclined stop face for abutting against the inclined end face of the clamping portion of the other of the clamp members so as to limit movement of the clamping portions of the clamp members from the releasing position to the clamping position.

The operating unit is connected to the clamp members, and is operable so as to pivot the clamp members for moving the clamping portions of the clamp members from the clamping position to the releasing position.

When the string is extended through the string inlet hole, between the inclined end faces of the clamping portions of the clamp members, and out of the at least one string outlet hole, and when the clamping portions of the clamp members are moved to the clamping position, the string is clamped by the inclined end faces of the clamping portions of the clamp members such that movement of the string in a direction toward the string inlet hole is prevented while movement of the string in an opposite direction away from the string inlet hole is permitted.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
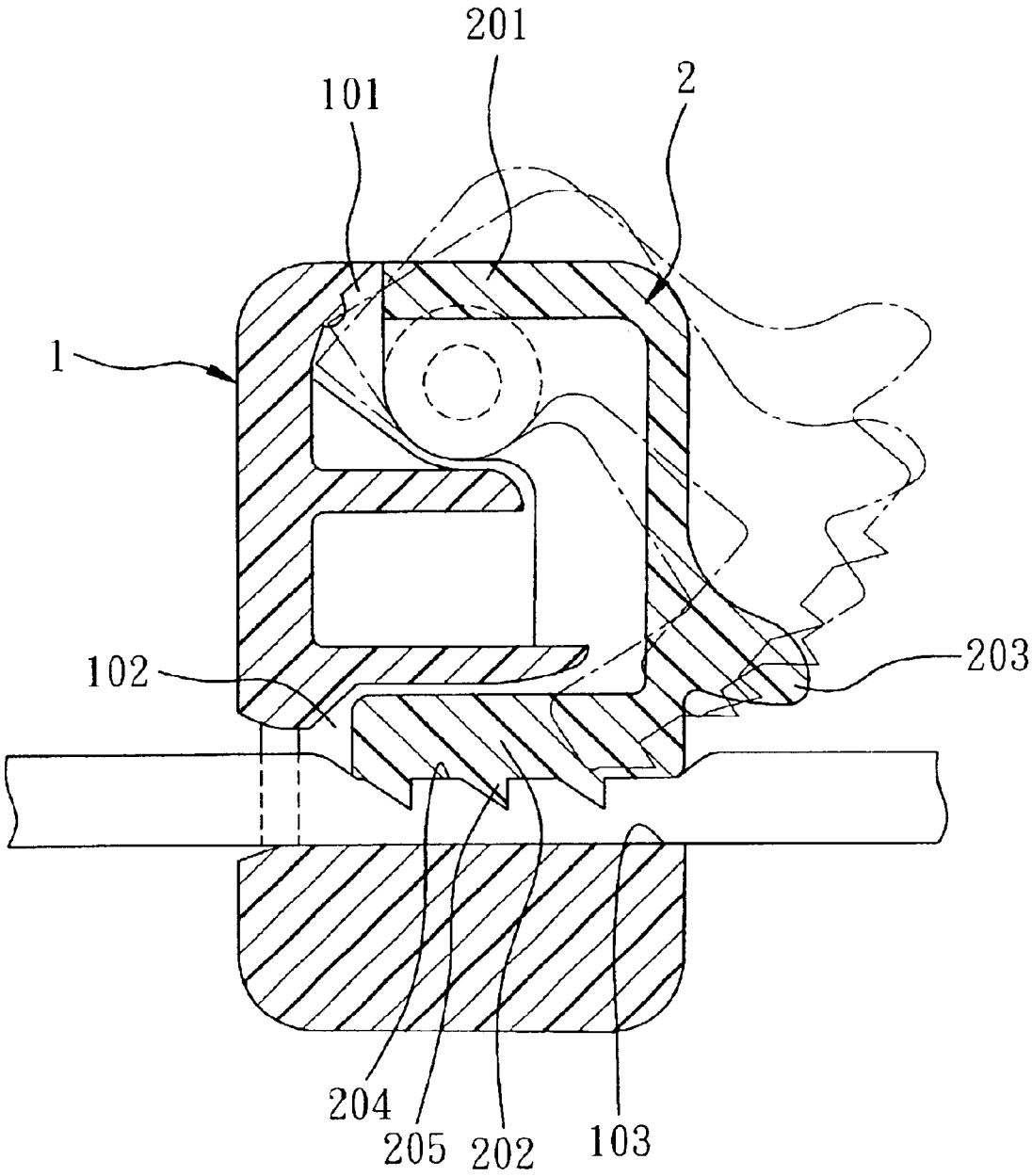
FIG. 1 PRIOR ART
FIG. 1 is a schematic cross-sectional view of a conventional clamp device for a string.
Figure 2:
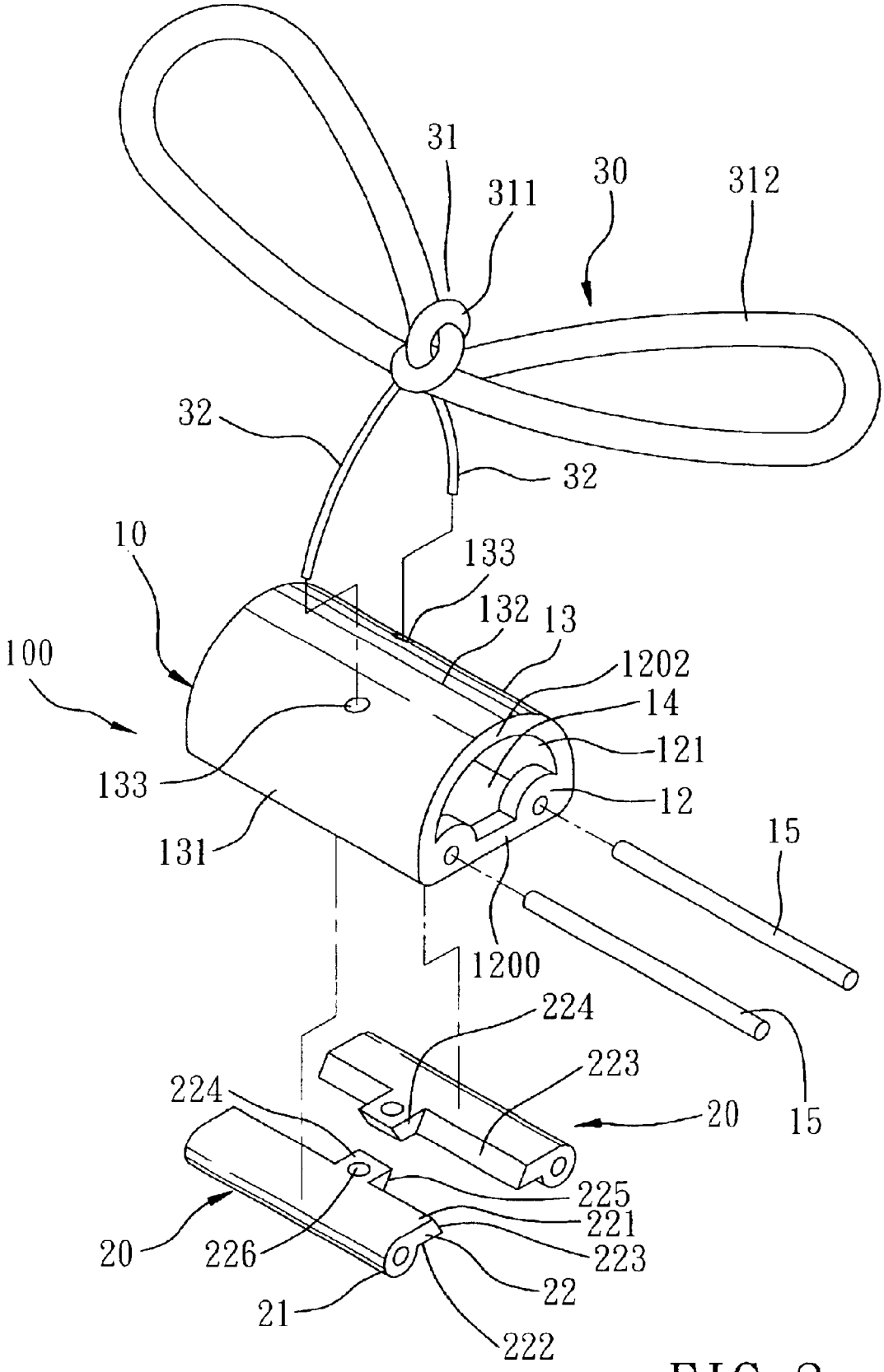
FIG. 2 is an exploded perspective view of the preferred embodiment of a clamp device according to the present invention.

Referring to FIGS. 2 to 5, the preferred embodiment of a clamp device 100 according to the present invention is shown to be applied to a shoe body 200 having a shoestring 300 strung thereon. The shoestring 300 has a pair of distal string segments 301 that are extended through the clamp device 100. The clamp device 100 is used to maintain a tightened state of the shoestring 300 on the shoe body 200, and includes a housing 10, a pair of clamp members 20, and an operating unit 30. It should be noted herein that, except for FIG. 3, the clamp device 100 of the preferred embodiment is not drawn to scale and is actually illustrated in a magnified form in the accompanying drawings for the sake of clarity.

The housing 10 confines an operating space 14, and is formed with a rectangular string inlet hole 11 that is communicated with the operating space 14. The string inlet hole 11 has a first hole axis (A), a pair of first hole edges opposite to each other in a first direction transverse to the first hole axis (A), and a pair of second hole edges opposite to each other in a second direction transverse to both the first direction and the first hole axis (A). In this embodiment, the housing 10 includes a pair of upright side walls 12 opposite to each other in the second direction, and a bridging wall 13 that interconnects the side walls 12 and that extends in the second direction. The side walls 12 and the bridging wall 13 cooperate to confine the operating space 14 of the housing 10. Preferably, each of the side walls 12 is generally semicircular in shape, and has a bottom edge 1200 and a curved top edge 1202 connected to the bottom edge 1200. The bridging wall 13 has a curved upper section 132 that interconnects the curved top edges 1202 of the side walls 12, and a pair of distal edges 131 that define the first hole edges of the string inlet hole 11, respectively. The bottom edges 1200 of the side walls 12 define the second hole edges of the string inlet hole 11, respectively. The housing 10 is further formed with a pair of string outlet holes 121 communicated with the operating space 14. In this embodiment, the string outlet holes 121 are formed respectively in the side walls 12, and have a second hole axis (B) transverse to the first hole axis (A). The curved upper section 132 of the bridging wall 13 is formed with a pair of cord holes 133 therethrough.

Figure 6:
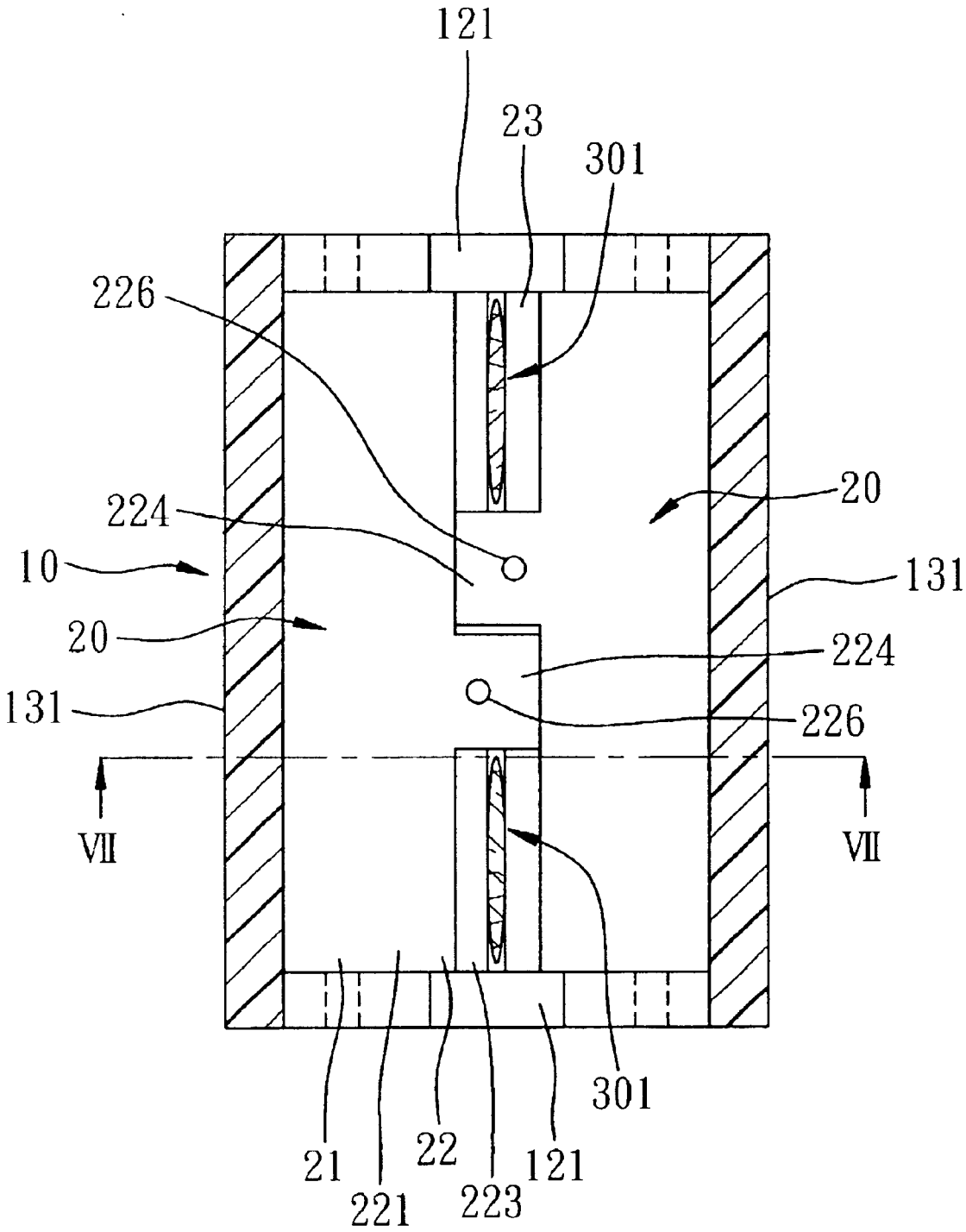
FIG. 6 is a sectional schematic top view of the preferred embodiment, illustrating a state where the distal string segments of the shoestring are clamped by a pair of clamp members of the clamp device.
Figure 7:
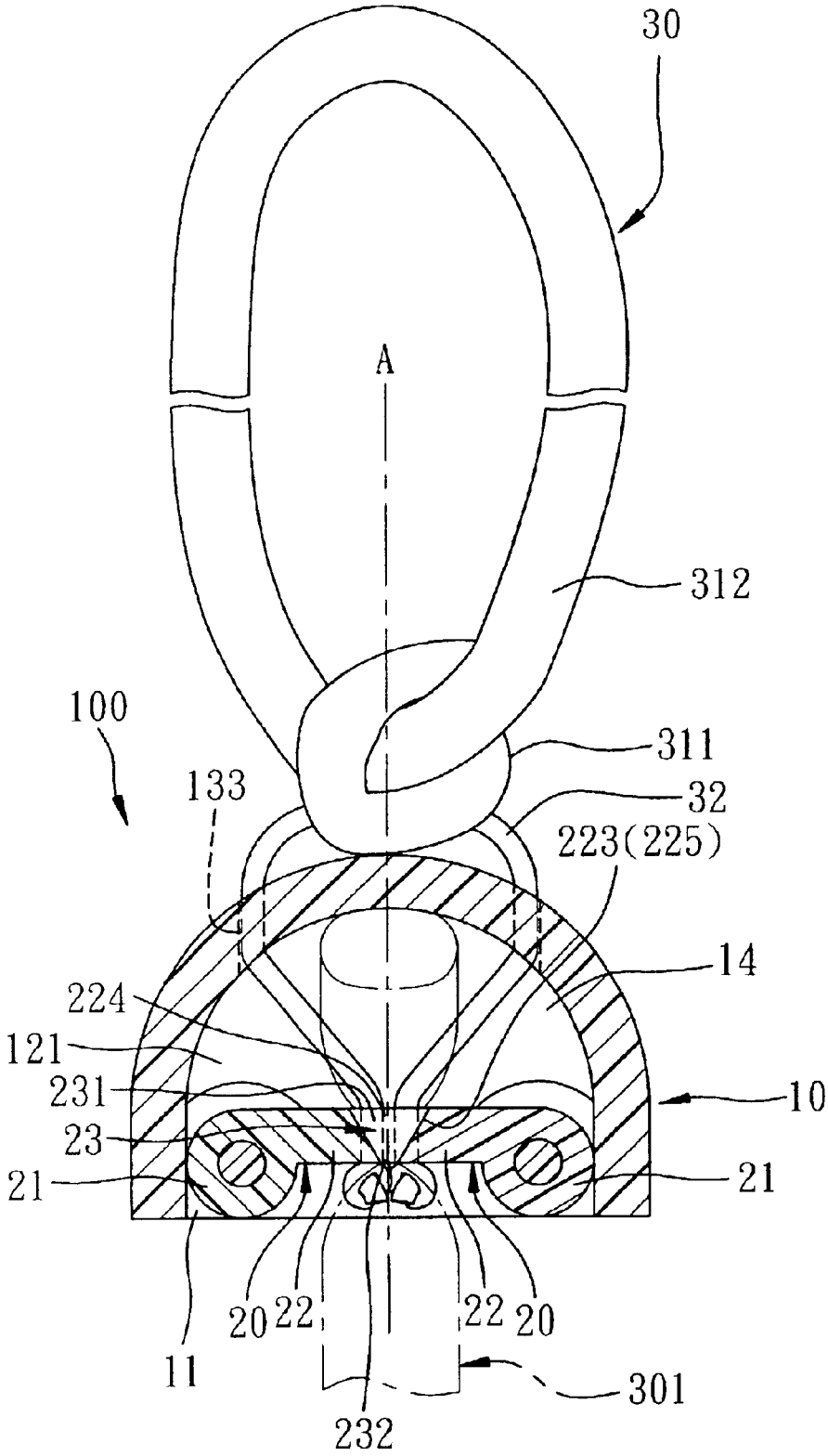
FIG. 7 is still another sectional view of the preferred embodiment, taken along line VII—VII in FIG. 6.

Each of the clamp members 20 is disposed in the operating space 14, and has a pivot portion 21 and a clamping portion 22 connected to the pivot portion 21. The pivot portion 21 of each of the clamp members 20 is disposed adjacent to a respective one of the first hole edges of the string inlet hole 11, and is pivotally retained in the housing 10 to permit pivoting movement of the clamp members 20 about a respective pivot axis that extends in the second direction. In this embodiment, two pivot axles 15 extend in the second direction between the side walls 12 of the housing 10, and the pivot portion 21 of each of the clamp members 20 is sleeved on a respective one of the pivot axles 15. The pivot axles 15 thus define the pivot axes of the clamp members 20. The clamping portion 22 of each of the clamp members 20 extends from the pivot portion 21 toward the first hole axis (A), and has a first side face 221, a second side face 222 that is opposite to the first side face 221 in a third direction transverse to the first and second directions and that is disposed to confront the string inlet hole 11, and an inclined end face 223 that is remote from the pivot portion 21 and that extends from the first side face 221 to the second side face 222. The clamp members 20 are pivotable in the operating space 14 of the housing 10 so as to move the clamping portions 22 thereof toward each other from a releasing position (see FIG. 8) to a clamping position (see FIGS. 6 and 7), where the inclined end faces 223 of the clamping portions 22 of the clamp members 20 cooperate to form a clamping space 23 that is communicated with the string inlet hole 11, that diverges along the first hole axis (A) in a direction away from the string inlet hole 11, and that has a wider section 231 and a narrower section 232 between the wider section 231 and the string inlet hole 11. The clamping portion 22 of each of the clamp members 20 is formed with a stop block 224 that extends from an intermediate segment of the inclined end face 223 and that is formed with an inclined stop face 225 for abutting against the inclined end face 223 of the clamping portion 22 of the other of the clamp members 20 so as to limit movement of the clamping portions 22 of the clamp members 20 from the releasing position to the clamping position, as best shown in FIGS. 6 and 7. In this embodiment, the stop block 224 of the clamping portion 22 of each of the clamp members 20 is formed with a through hole 226 that extends in the third direction.

Figure 8:
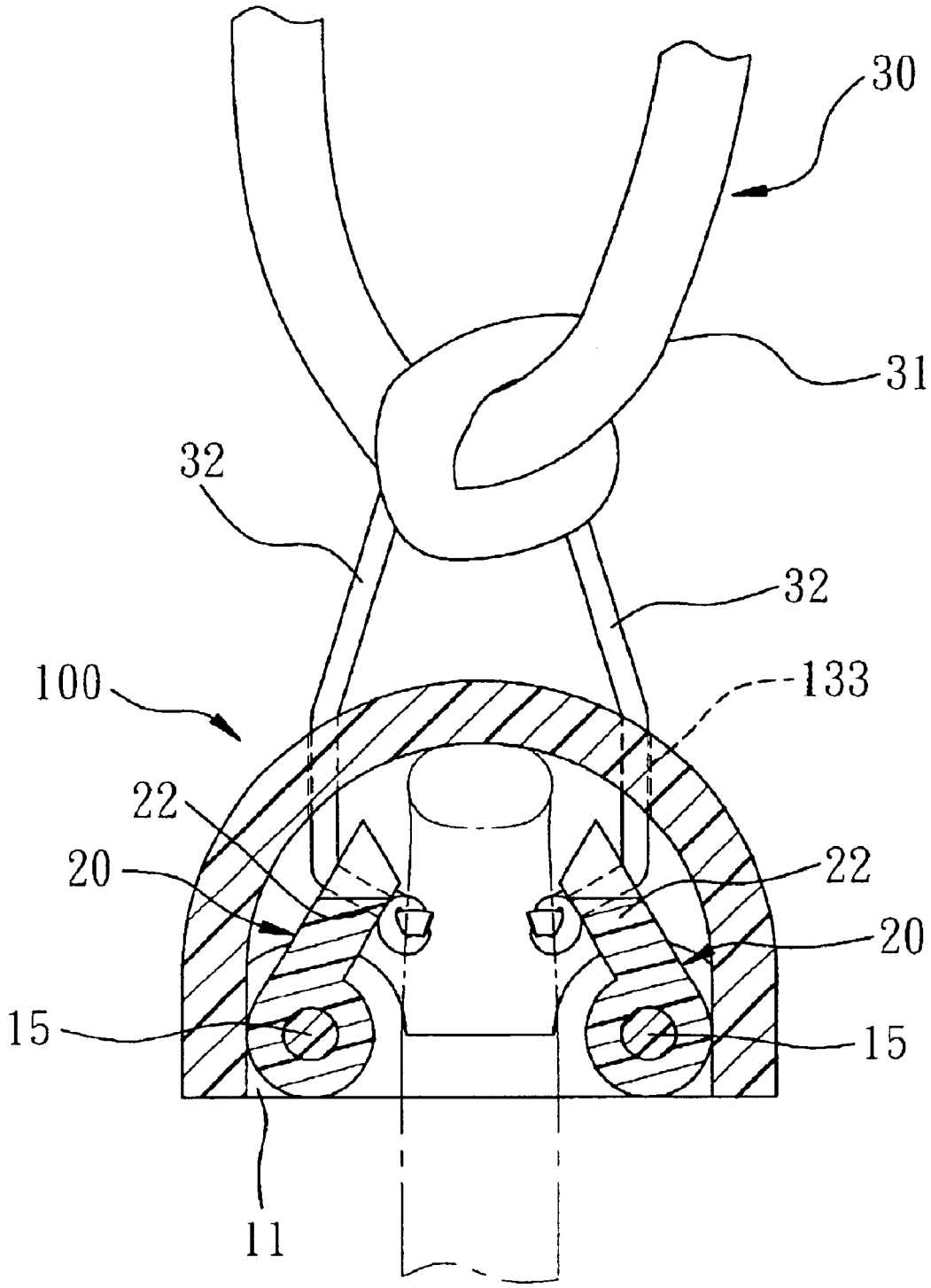
FIG. 8 is yet another sectional view of the preferred embodiment, illustrating a state where an operating unit is pulled to pivot the clamp members for releasing the distal string segments of the shoestring.

The operating unit 30 is connected to the clamp members 20, and is operable so as to pivot the clamp members 20 for moving the clamping portions 22 of the clamp members 20 from the clamping position to the releasing position, as best shown in FIG. 8. In this embodiment, the operating unit 30 includes an operating portion 31 disposed outwardly of the housing 10 and above the curved upper section 132 of the bridging wall 13, and a pair of cord sections 32 connected to the operating portion 31. Preferably, the operating portion 31 is an assembly of a knot 311 and a pair of loops 312 connected to the knot 311 for decorative purposes. The cord sections 32 extend from the operating portion 31, into the operating space 14 through a respective one of the cord holes 133 in the bridging wall 13 of the housing 10, and through the through hole 226 in the stop block 224 on the clamping portion 22 of a respective one of the clamp members 20. Each cord section 32 has a knotted end, thereby connecting the cord section 32 to the stop block 224 of the respective clamp member 20.

Figure 3:
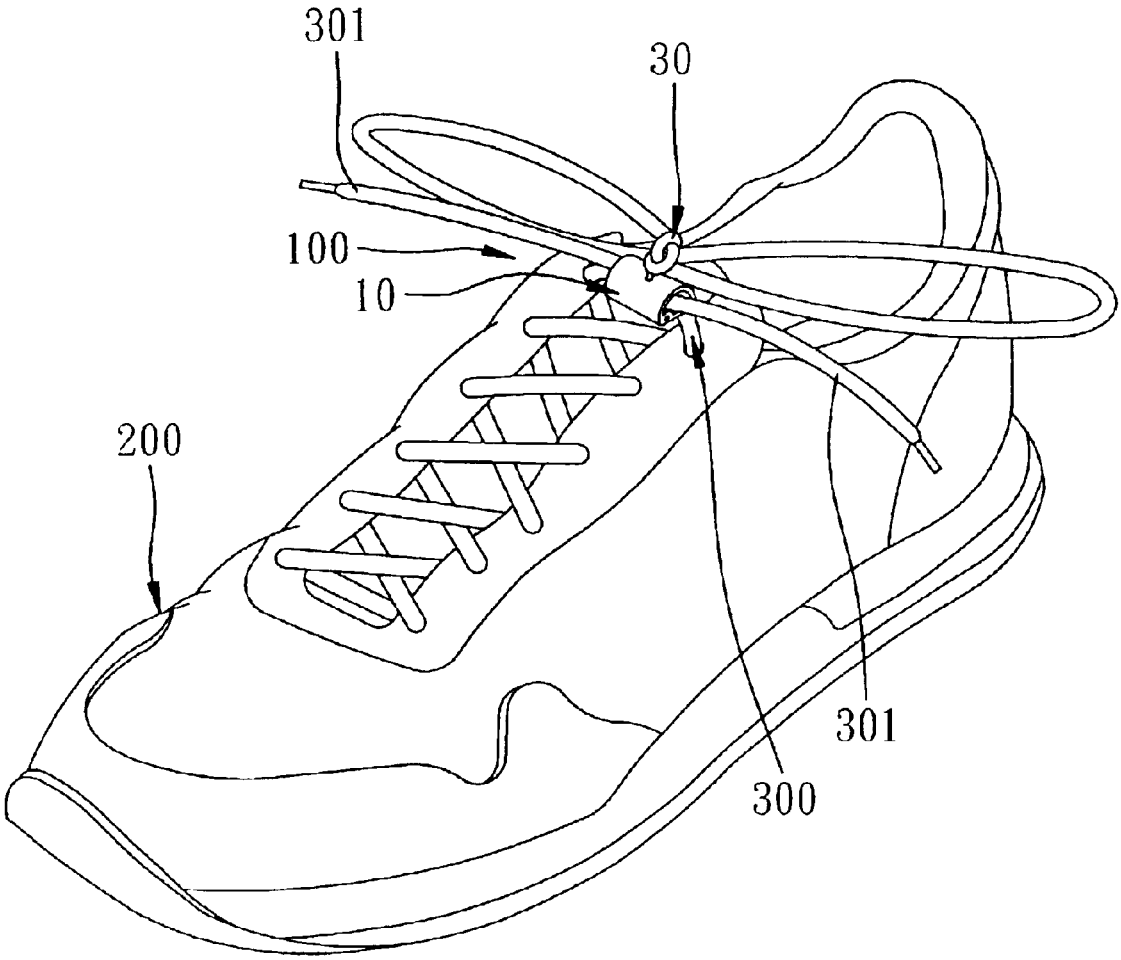
FIG. 3 is a perspective view to illustrate the preferred embodiment when applied to a shoestring on a shoe body.
Figure 4:
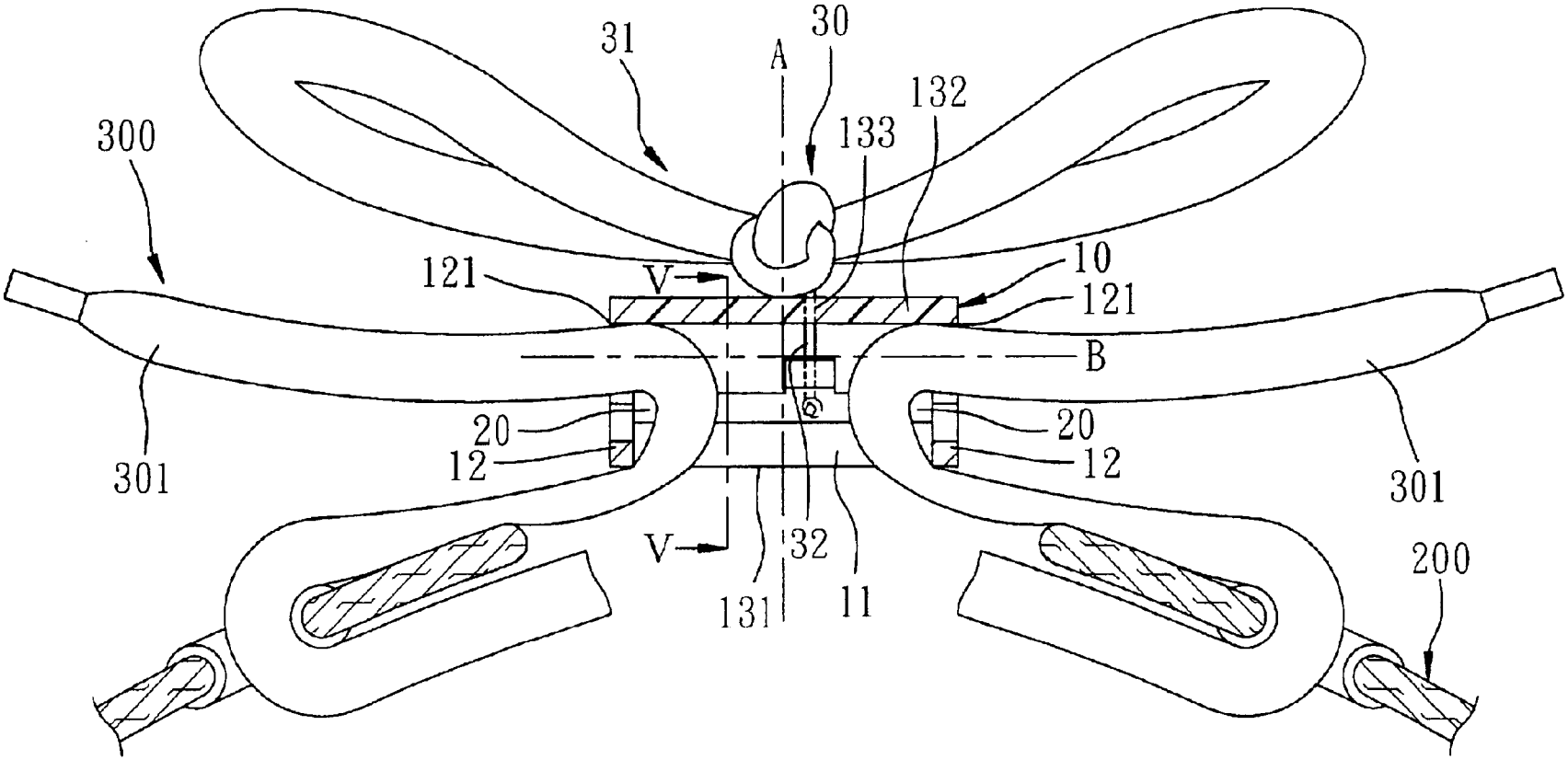
FIG. 4 is a longitudinal schematic cross-sectional view of the preferred embodiment, illustrating a state where distal string segments of the shoestring are loosely extended through the clamp device.
Figure 5:
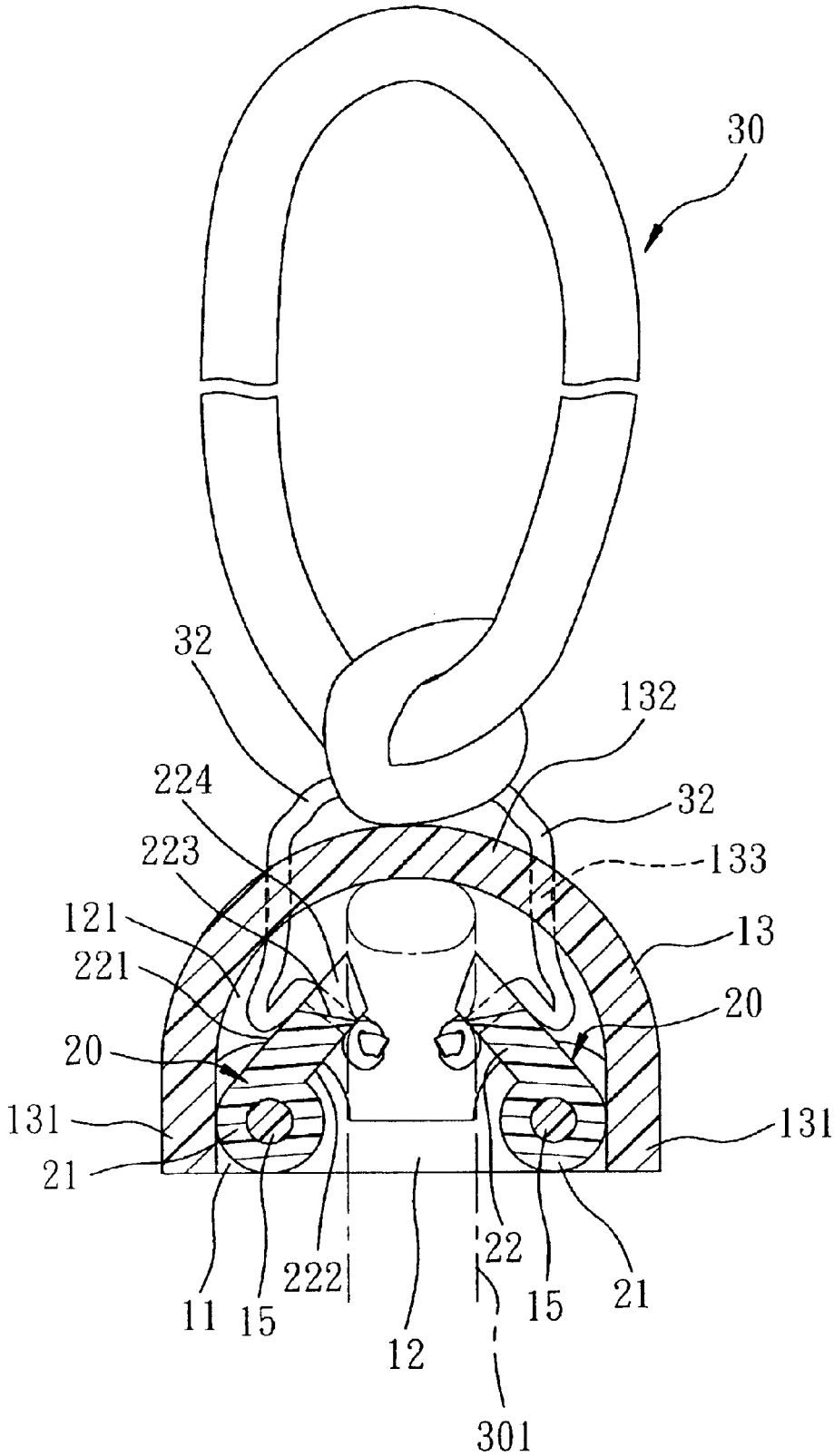
FIG. 5 is another sectional view of the preferred embodiment, taken along line V—V in FIG. 4.

In use, each of the distal string segments 301 of the shoestring 300 is extended through the string inlet hole 11, between the inclined end faces 223 of the clamping portions 22 of the clamp members 20, and out of a respective one of the string outlet holes 121, as best shown in FIGS. 4 and 5. Thereafter, the distal string segments 301 of the shoestring 300 are pulled apart to tighten the shoestring 300, which is strung on the shoe body 200 (see FIGS. 3 and 4). The distal string segments 301 of the shoestring 300 cooperate with the operating unit 30 to form a double-bow string configuration, as best shown in FIG. 3.

When the shoestring 300 is tightened, and the pulling action on the distal string segments 301 of the shoestring 300 is removed, the eyelet tabs of the shoe body 200 apply a pulling force on the shoestring 300 in a direction for moving the distal string segments 301 toward the string inlet hole 11. However, because the distal string segments 301 of the shoestring 300 are in contact with the inclined end faces 223 of the clamping portions 22 of the clamp members 20, the pulling action of the eyelet tabs will enable the distal string segments 301 of the shoestring 300 to push the clamping portions 22 of the clamp members 20 to the clamping position. As best shown in FIGS. 6 and 7, when the clamping portions 22 of the clamp members 20 are at the clamping position, the distal string segments 301 of the shoestring 300 are clamped by the inclined end faces 223 of the clamping portions 22 at the narrower section 232 of the clamping space 23 such that movement of the distal string segments 301 of the shoestring 300 in the direction toward the string inlet hole 11 is prevented, thereby maintaining a tightened state of the shoestring 300. At this time, the stop block 224 on the clamping portion 22 of each of the clamp members 22 abuts against the inclined end face 223 of the clamping portion 22 of the other clamp member 20 to limit movement of the clamping portions 22 of the clamp members 20 from the releasing position to the clamping position.

Thereafter, when it is desired to further tighten the shoestring 300 on the shoe body 200, it is merely required to pull apart the distal string segments 301 of the shoestring 300. When the distal string segments 301 are pulled apart, the distal string segments 301 push against the second side faces 222 of the clamping portions 22 of the clamp members 20 to permit movement of the distal string segments 301 of the shoestring 300 in the direction away from the string inlet hole 11.

Referring to FIG. 8, when it is desired to loosen the shoestring 300, the operating portion 31 of the operating unit 30 is simply pulled away from the bridging wall 13 of the housing 10, thereby causing the cord sections 32 to pull the stop blocks 224 on the clamping portions 22 so as to result in pivoting movement of the clamp members 20 about the pivot axles 15 for moving the clamping portions 22 of the clamp members 20 from the clamping position to the releasing position.

The following are some of the advantages of the clamp device 100 of this invention:

1. Tightening of the shoestring 300 is accomplished by merely pulling apart the distal string segments 301. Loosening of the shoestring 300 is subsequently accomplished by simply pulling the operating portion 31 of the operating unit 30. The clamp device 100 is thus easy to operate.

2. The distal string segments 301 of the shoestring 300 are clamped by the inclined end faces 223 on the clamping portions 22 of the clamp members 20. As compared to the conventional clamp device described beforehand, a teethed surface is not used to engage the distal string segments 301 in the clamp device 100 of this invention to minimize wearing of the shoestring 300.

3. Because the shoestring 300 is loosened by operating the operating unit 30, the overall size of the clamp device 100 can be made much smaller as compared to that of the conventional clamp device described beforehand.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A clamp device for a string, comprising:

a housing confining an operating space and formed with a string inlet hole and at least one string outlet hole that are communicated with said operating space, said string inlet hole having a first hole axis and a pair of first hole edges opposite to each other in a first direction transverse to the first hole axis;

a pair of clamp members disposed in said operating space, each of said clamp members having a pivot portion and a clamping portion connected to said pivot portion, said pivot portion of each of said clamp members being disposed adjacent to a respective one of said first hole edges of said string inlet hole, and being pivotally retained in said housing to permit pivoting movement of said clamp members about a respective pivot axis that extends in a second direction transverse to both the first direction and the first hole axis, said clamping portion of each of said clamp members extending from said pivot portion toward the first hole axis, and having a first side face, a second side face that is opposite to said first side face in a third direction transverse to the first and second directions and that is disposed to confront said string inlet hole, and an inclined end face that is remote from said pivot portion and that extends from said first side face to said second side face, said clamp members being pivotable so as to move said clamping portions thereof toward each other from a releasing position to a clamping position, where said inclined end faces of said clamping portions of said clamp members cooperate to form a clamping space that is communicated with said string inlet hole, that diverges along the first hole axis in a direction away from said string inlet hole, and that has a wider section and a narrower section between said wider section and said string inlet hole, said clamping portion of each of said clamp members being formed with a stop block that extends from said inclined end face and that is formed with an inclined stop face for abutting against said inclined end face of said clamping portion of the other of said clamp members so as to limit movement of said clamping portions of said clamp members from the releasing position to the clamping position; and an operating unit connected to said clamp members and operable so as to pivot said clamp members for moving said clamping portions of said clamp members from the clamping position to the releasing position;

whereby, when the string is extended through said string inlet hole, between said inclined end faces of said clamping portions of said clamp members, and out of said at least one string outlet hole, and when said clamping portions of said clamp members are moved to the clamping position, the string is clamped by said inclined end faces of said clamping portions of said clamp members such that movement of the string in a direction toward said string inlet hole is prevented while movement of the string in an opposite direction away from said string inlet hole is permitted.

2. The clamp device as claimed in claim 1, wherein said housing includes a pair of upright side walls opposite to each other in the second direction, and a bridging wall interconnecting said side walls and extending in the second direction.

3. The clamp device as claimed in claim 2, wherein said string inlet hole further has a pair of second hole edges opposite to each other in the second direction, each of said side walls defining a corresponding one of said second hole edges.

4. The clamp device as claimed in claim 3, wherein each of said side walls has a bottom edge and a curved top edge connected to said bottom edge, said bridging wall having a curved upper section that interconnects said curved top edges of said side walls, said bridging wall further having a pair of distal edges that define said first hole edges, respectively.

5. The clamp device as claimed in claim 2, further comprising a pair of pivot axles that extend in the second direction between said side walls, said pivot portion of each of said clamp members being sleeved on a respective one of said pivot axles.

6. The clamp device as claimed in claim 2, wherein said housing is formed with a pair of said string outlet holes, each of which is formed in a respective one of said side walls.

7. The clamp device as claimed in claim 6, wherein said string outlet holes have a second hole axis transverse to the first hole axis.

8. The clamp device as claimed in claim 2, wherein said bridging wall is formed with a pair of cord holes, and said operating unit includes an operating portion disposed outwardly of said housing, and a pair of cord sections connected to said operating portion, said cord sections extending into said operating space through a respective one of said cord holes and being connected to said clamping portion of a respective one of said clamp members.

9. The clamp device as claimed in claim 8, wherein each of said cord sections is connected to said stop block of said clamping portion of the respective one of said clamp members.

10. The clamp device as claimed in claim 8, wherein said operating portion is an assembly of a knot and a pair of loops connected to said knot.

* * * * *